US005694338A

United States Patent [19]

Inomata et al.

[11] Patent Number: 5,694,338

[45] Date of Patent: Dec. 2, 1997

[54] METHOD FOR SENSING OUTLET CLEARANCE OF CONE CRUSHER

[75] Inventors: Shoji Inomata; Takeshi Tanaka; Taketo Ito, all of Takasago, Japan

[73] Assignee: Kabushiki Kaisha Kobe Seiko Sho, Kobe, Japan

[21] Appl. No.: 556,395

[22] Filed: Nov. 9, 1995

[30] Foreign Application Priority Data

Nov. 11, 1994 [JP] Japan ..... HEI 6-277682

[51] Int. Cl.[6] ..... B02C 2/04

[52] U.S. Cl. ..... 364/560; 364/561; 241/30; 241/37; 241/208

[58] Field of Search ..... 364/560, 561; 241/268, 207, 215, 208, 293, 37, 203, 206, 292.1

[56] References Cited

U.S. PATENT DOCUMENTS

| | | | |
|---|---|---|---|
| 3,700,175 | 10/1972 | Saito | 241/37 |
| 3,944,146 | 3/1976 | Stockmann et al. | 241/30 |
| 4,509,699 | 4/1985 | Tanaka et al. | 241/268 |
| 4,586,664 | 5/1986 | Tanaka . | |
| 4,787,563 | 11/1988 | Tanaka et al. . | |
| 4,793,560 | 12/1988 | Schrodl | 241/30 |
| 4,834,298 | 5/1989 | Murata . | |
| 4,871,119 | 10/1989 | Murata . | |

FOREIGN PATENT DOCUMENTS

| | | |
|---|---|---|
| 6-39133 | 5/1994 | Japan . |
| 6-154630 | 6/1994 | Japan . |
| 6-154631 | 6/1994 | Japan . |
| 6-190296 | 7/1994 | Japan . |

*Primary Examiner*—Emanuel T. Voeltz
*Assistant Examiner*—Hien Vo
*Attorney, Agent, or Firm*—Oblon, Spivak, McClelland, Maier & Neustadt, P.C.

[57] ABSTRACT

An angle θ formed between a horizontal line passing through the contact point P and a slant surface of a mantle based on an empirical rule corresponding to the vertical distance L ranging from the reference line S to the contact point P of the mantle continued to vary due to abrasion is inputted in advance into an angle inputting and outputting device, the angle θ corresponding to the vertical distance L detected by a distance sensing device in reference to an angle inputted value is selected and at the same time the selected angle is inputted into the distance calculating device, a product of a distance difference ΔL between the contact point P of the concave and the contact point P of the mantle and a cosine value of the angle θ is calculated by the distance calculating device, resulting in that an inputting operation for the angle θ can be eliminated, so that a stop time of the cone crusher is reduced and an operating efficiency of the cone crusher is improved.

6 Claims, 4 Drawing Sheets

METHOD FOR SENSING OUTLET CLEARANCE OF CONE CRUSHER

BACKGROUND OF THE INVENTION

1. Field of the Invention

This invention relates to a method for sensing an outlet clearance of a cone crusher for use in crushing ores or rocks and the like.

2. Description of the Related Art

A cone crusher is comprised of a concave and a mantle fitted outwardly at a cone segment formed at an upper portion of a main shaft, said main shaft being rotatably arranged in a vertical orientation at a central part of the concave in its diametrical direction, wherein ores or rocks and the like are crushed between the concave and the mantle. As such a cone crusher, there are two types of crushers, one in which the concave is moved up and down in order to adjust an amount of abrasion and the other in which the mantle is moved up and down to adjust an amount of abrasion. In such cone crushers as described above, it is necessary to keep a particle size of ores or rocks and the like within a predetermined range and it is an essential requirement to keep a constant clearance between the concave and a part near an outer periphery of the mantle, i.e. a constant outlet clearance.

Due to this fact, although it is necessary to detect the outlet clearance, the cone crusher 1 in which the concave 2 is moved up and down is constructed such that as shown in FIG. 4, the concave 2 is threadably fitted to a concave support 1*a*, resulting in that an amount of rotation of the concave support 1*a* is detected by a proximity detector and the like to calculate a distance La between a reference position S and a contact point Pa in the mantle 3, and to calculate a distance Lb between the reference position S and a contact point Pb in the concave 2, and then a difference $\Delta L$ of distances in a vertical direction between the contact point Pa of the mantle 3 and the contact point Pb of the concave 2 is calculated in reference to these distances, $\Delta L \times \cos\theta$ is calculated in reference to $\Delta L$ and an angle $\theta$ formed between a horizontal line passing through the contact point Pa of the mantle 3 and a slant surface of the mantle 3 and then an outlet clearance G between the cone cape and the mantle 3 is calculated.

In another cone crusher in which the mantle is moved up and down as shown in FIG. 5, a differential transformer or a magnetostriction displacement meter or the like is used for calculating the distance La between the reference position S and the contact point Pa of the concave 2, calculating the distance Lb between the reference position S and the contact point Pb of the mantle 3, measuring a difference $\Delta L$ of distance in a vertical direction between the contact points Pa, Pb of the concave 2 or the mantle 3 in reference to these values, and then a product of $\Delta L \times \cos\theta$ of the difference $\Delta L$ and a cosine of the angle $\theta$ between the horizontal line passing through the contact point Pb of the mantle 3 is calculated by a clearance calculating device so as to get the outlet clearance G between the cone cape 2 and the part near the outer periphery of the mantle 3.

Since the angle $\theta$ is varied due to abrasion between the concave and the mantle and the angle $\theta$ is gradually decreased as the abrasion grows, the calculated values are gradually spaced apart from the actual outlet clearance G. Due to this fact, in the prior art, the angle $\theta$ was corrected in response to a difference L at the inputting and outputting device every time the abrasion at the concave or the mantle is progressed and then the corrected angle $\theta$ was inputted to calculate the outlet clearance G. The number of inputting works of the angle $\theta$ carried out until the cone cape or the mantle is replaced with a new one is normally about 30 times in the case that the items to be crushed are rocks. However, when the inputting work of the angle $\theta$ was carried out, the operation of the cone crusher had to be stopped to carry out an actual-measuring work for the minimum outlet clearance, resulting in that the operation was not only a quite troublesome work but also caused trouble in improving an operating efficiency of the cone crusher.

SUMMARY OF THE INVENTION

It is an object of the present invention to provide a method for sensing an outlet clearance of a cone crusher in which an inputting work for the angle $\theta$ is not necessary.

The preferred embodiment of the present invention is carried out such that a first distance between the contact point and the reference position is detected at a condition in which the concave and the mantle are contacted to each other; a second distance between a contact point where one of the concave and the mantle is moved and the reference position is detected at a condition in which the concave and the mantle are spaced apart; a difference between the first distance and the second distance is calculated; and a product of a cosine value of an angle which is varied in response to a vertical distance between the contact point where one of the cone cape or the mantle is not moved and an angle formed between the horizontal line passing through the contact point and a slant surface of the cone cape or the mantle and the difference is calculated to detect the outlet clearance.

Accordingly, even if the abrasion of the concave or the mantle is progressed being different from the prior art, the actual outlet clearance and the outlet clearance calculated by the clearance calculating device is not different. As a result, the inputting work of the corrected angle $\theta$ can be eliminated and an operating efficiency of the cone crusher is increased.

DETAILED DESCRIPTION OF THE PREFERRED EMBODIMENTS

The present invention has been completed in View of the fact that abrasion condition between the concave and the mantle is kept constant from time of new one to replacing time and a varying state of the angle θ caused by abrasion is not changed if physical properties of rocks and particle size of supplied raw rocks are kept constant and a load of the cone crusher is not substantially changed, and under such a condition as above, if a plurality of angles θ n (n=1, 2, 3, . . . n) corresponding to a vertical distance L between the reference position varying by abrasion and the contact point P on one of the concave or the mantle which is not moved are inputted again to an inputting or outputting device, an angle θ corresponding to the vertical distance L detected by the distance sensing device is selected from the inputted angles θ n, and thereby the outlet clearance G is calculated to eliminate the inputting work for the angle θ.

The method for sensing an outlet clearance of a cone crusher of the first preferred embodiment of the present invention will be described in reference to FIG. 1A for showing a positional relationship between the concave and the mantle under initial condition, FIG. 1B for showing a case in which abrasion is progressed and the maximum distance is produced in a vertical direction between the reference position and the mantle, and FIG. 1C for illustrating a relation of the angle θ corresponding to the distance L between the reference position and the contact point P of the mantle varied by abrasion.

Figure 1A:
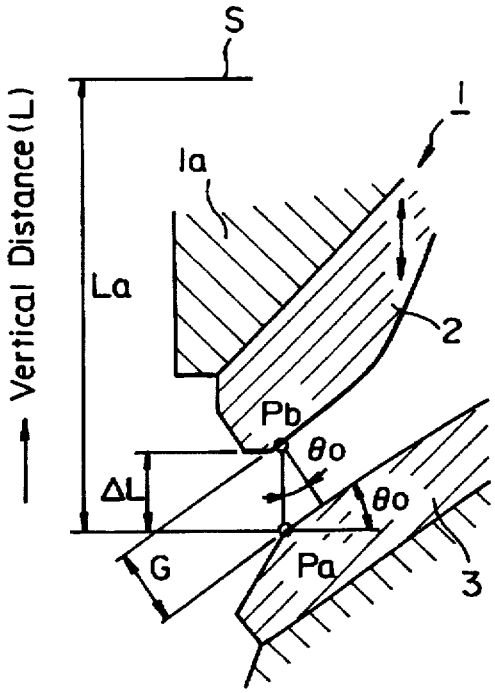
FIG. 1A is a schematic view for showing a main portion to indicate a positional relation between the concave and the mantle at an initial condition of the cone crusher in the first preferred embodiment of the present invention.
Figure 1B:
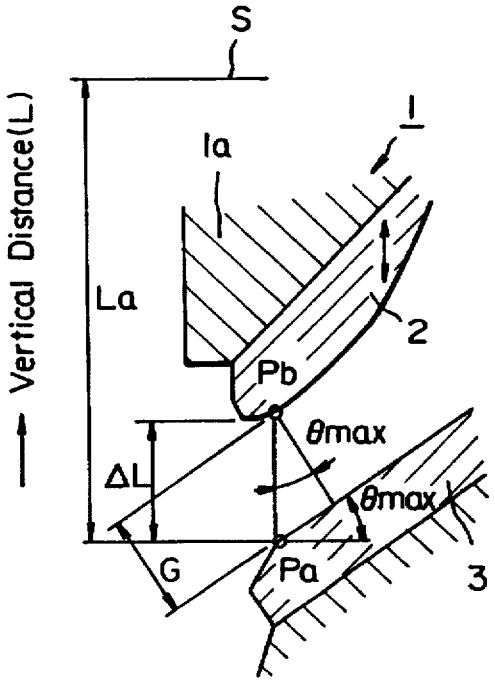
FIG. 1B is a schematic view for showing the main portion in the first preferred embodiment of the present invention to indicate the case in which abrasion is progressed to be the maximum distance between the reference position and the mantle in a vertical direction.

That is, reference numeral 1 shown in FIG. 1A and FIG. 1B denotes a cone crusher, wherein a concave 2 of the cone crusher 1 is threadably fixed to a screw (not shown) arranged inside a concave support 1*a* in such a way that the concave can be moved up and down. Then, a mantle 3 is mounted at a lower position spaced apart by an outlet clearance G in respect to the lower side of the concave 2.

An angle $\theta_0$ between a slant surface of the mantle 3 and the horizontal line for calculating the outlet clearance G at an initial stage of the cone crusher 1 having such a configuration as above is calculated as an angle at a position of the contact point Pa when the concave 2 is moved down and contacted with the mantle 3. Then, the concave 2 is lifted up until the outlet clearance G becomes a predetermined value.

When a proper outlet clearance G is formed between the concave 2 and the mantle 3 under the lifting-up operation of the concave 2, the items to be crushed can be crushed, although abrasion of the concave 2 and the mantle 3 are progressed as the operation is continued to cause the angle θ to be varied, so that when the outlet clearance G after abrasion is calculated on the basis of the angle $\theta_0$ calculated under an initial setting, the calculated outlet clearance G is gradually spaced apart from the actual outlet clearance to cause an inaccurate value to be attained. However, in the preferred embodiment, as shown in FIG. 1C, the angles $\theta_0$, $\theta_1$, $\theta_2$, $\theta_3$ . . . , $\theta_{max}$ based on an empirical rule corresponding to the vertical distances $L_0$, $L_1$, $L_2$, $L_3$ . . . , $L_{max}$ ranging from the reference position S to the contact point Pa of the mantle 3 which continues to vary by abrasion are inputted in advance into an angle inputting or outputting device (not shown).

Although the aforesaid vertical distances $L_0$, $L_1$, $L_2$, $L_3$, . . . $L_{max}$ and the distance Lb between the reference position S and the concave 2 are detected together by a distance sensing device (not shown), each of the distances detected by the distance Sensing device is inputted into the clearance calculating device (not shown), and then a difference ΔL is calculated by the clearance calculating device.

In addition, in concurrent with this operation, an angle θ corresponding to the vertical distance L, between the reference position S detected by the distance sensing device and the contact point Pa of the mantle 3 varying due to wear is selected from angles $\theta_0$, $\theta_1$, $\theta_2$, $\theta_3$ . . . , $\theta_{max}$, the selected angle θ is inputted into the clearance calculating device and at the same time the outlet clearance G is calculated in reference to a product of the aforesaid difference ΔL and a cosine of the selected angle θ, i.e. ΔL ×cosθ is calculated by the clearance calculating device. As described above, the outlet clearance G is calculated in reference to the angles $\theta_0$, $\theta_1$, $\theta_2$, $\theta_3$ . . . , $\theta_{max}$ based on an empirical rule, so that the actual outlet clearance and the outlet clearance got through calculation are not spaced apart wide as found in the prior art, resulting in that an inputting work for the angle θ acting to require a substantial work can be eliminated and then an operating ratio of the cone crusher can be substantially increased.

In addition, the angle θ in the case that the vertical distance L between the reference position S detected by the distance sensing device and the contact point P of the mantle 3 varying by abrasion is set between $L_4$ and $L_5$, for example, and the the angle θ s corresponding to $L_4$ and $L_5$ are $\theta_4$, $\theta_5$, respectively is calculated by a linear interpolation equation of $\theta_4$ to $\theta_5$, i.e. an equation of $\theta=\theta_4+\{(L-L_4)/(L_4-L_5)\}\times(\theta_5-\theta_4)$.

Figure 2:
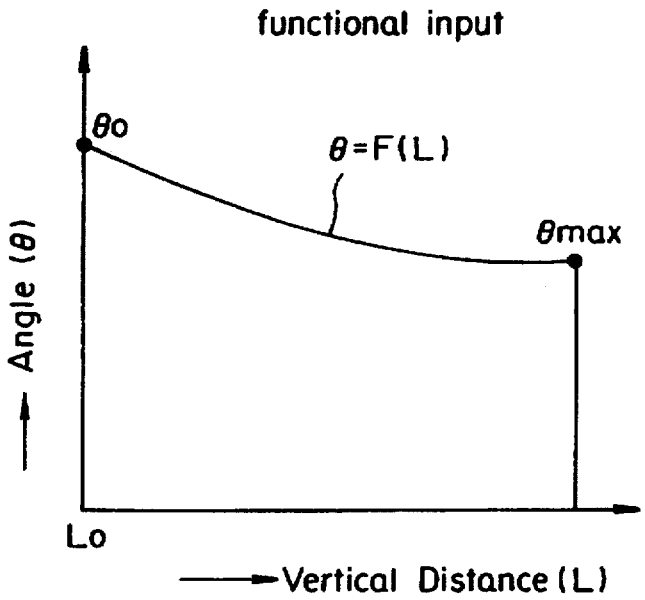
FIG. 2 is a relative illustration of an angle $\theta$ corresponding to the distance L between the reference position and the contact point P of the mantle varied due to its abrasion in the second preferred embodiment of the present invention.

Then, a method for sensing an outlet clearance of the second preferred embodiment of the present invention will be described in reference to FIG. 2 for showing a relation of an angle θ corresponding to the distance L between the reference position S and the contact point Pa of the mantle varying in response to abrasion. In this preferred embodiment, a functional equation of θ=F(L) between the vertical distance L ranging from the reference position S to the contact point P of the mantle varying by wear and an angle θ based on an empirical rule corresponding to the vertical distance L is calculated and the functional equation of θ=F(L) is inputted in advance into an angle inputting and outputting device.

Of course, it is apparent that the distance L and a distance between the reference position and the contact point of the concave are detected by the distance sensing device in the same manner as that of the aforesaid preferred embodiment, each of the distances detected by the distance sensing device is inputted into the distance sensing device, the difference ΔL is calculated by the clearance calculating device, wherein the angle θ corresponding to the vertical distance L ranging from the reference position detected by the distance sensing device to a contact point of the mantle varying due to its abrasion is calculated by the functional equation of θ=F(L) by an angle inputting and outputting device, the angle θ calculated by the functional equation of θ=F(L) is inputted into the clearance calculating device and concurrently the outlet clearance G is calculated in reference to a product of the aforesaid difference ΔL and the selected angle θ, so that this preferred embodiment has the substantially same effect as that of the aforesaid preferred embodiment.

Figure 3:
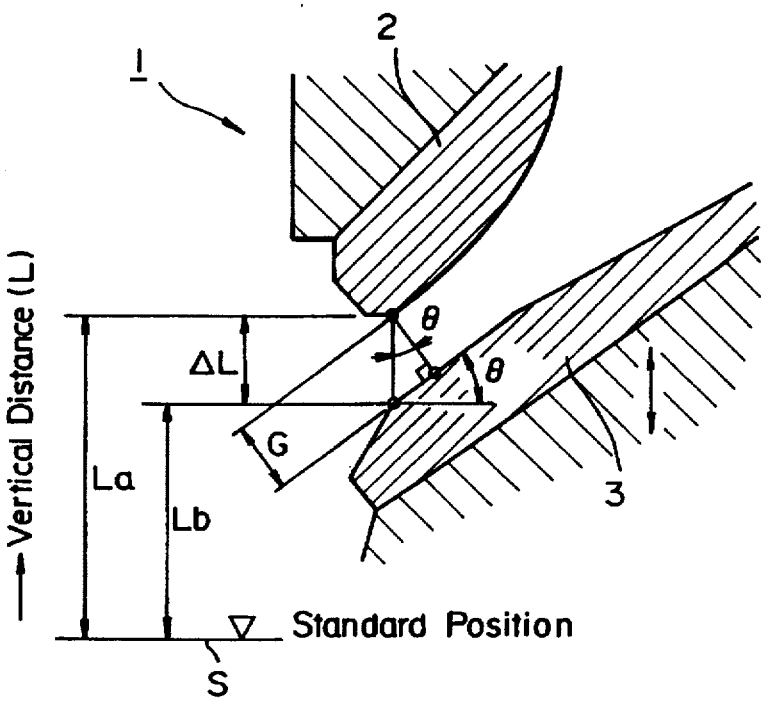
FIG. 3 is a schematic illustration to show a main portion in the third preferred embodiment of the present invention.
Figure 4:
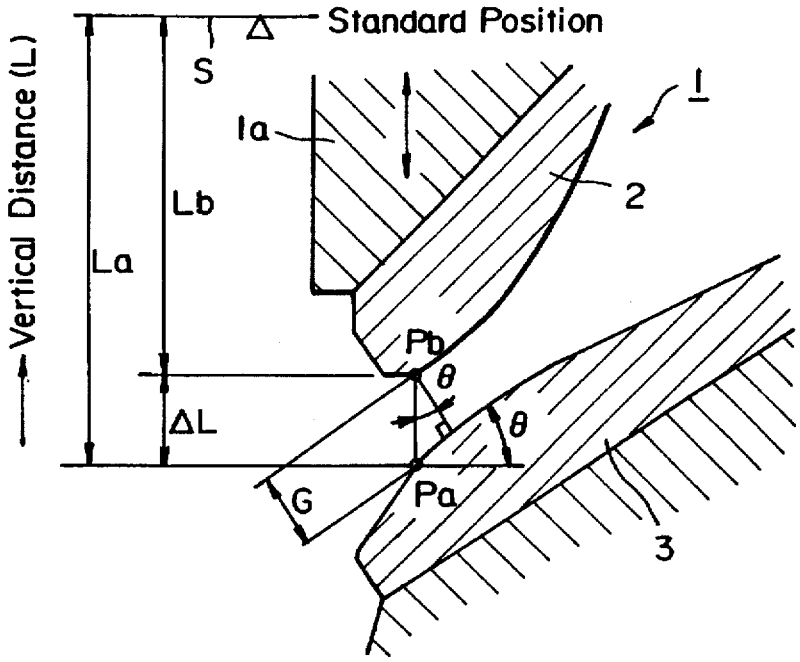
FIG. 4 PRIOR ART
FIG. 4 is a schematic illustration to show a main portion in the cone crusher in the prior art.
Figure 5:
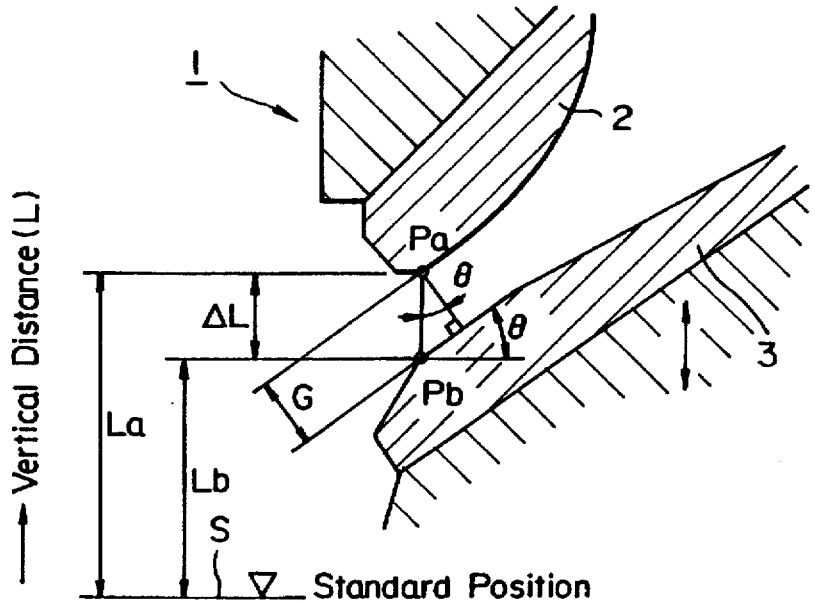
FIG. 5 PRIOR ART
FIG. 5 is a schematic illustration to show a major part in the cone crusher in the prior art.

The method for sensing the outlet clearance in accordance with the third preferred embodiment of the present invention will be described in reference to FIG. 3 and FIG. 1C, wherein this cone crusher 1 is constructed such that the concave 2 is fixed and the mantle 3 can be moved up and down by a hydraulic cylinder (not shown).

Figure 1C:
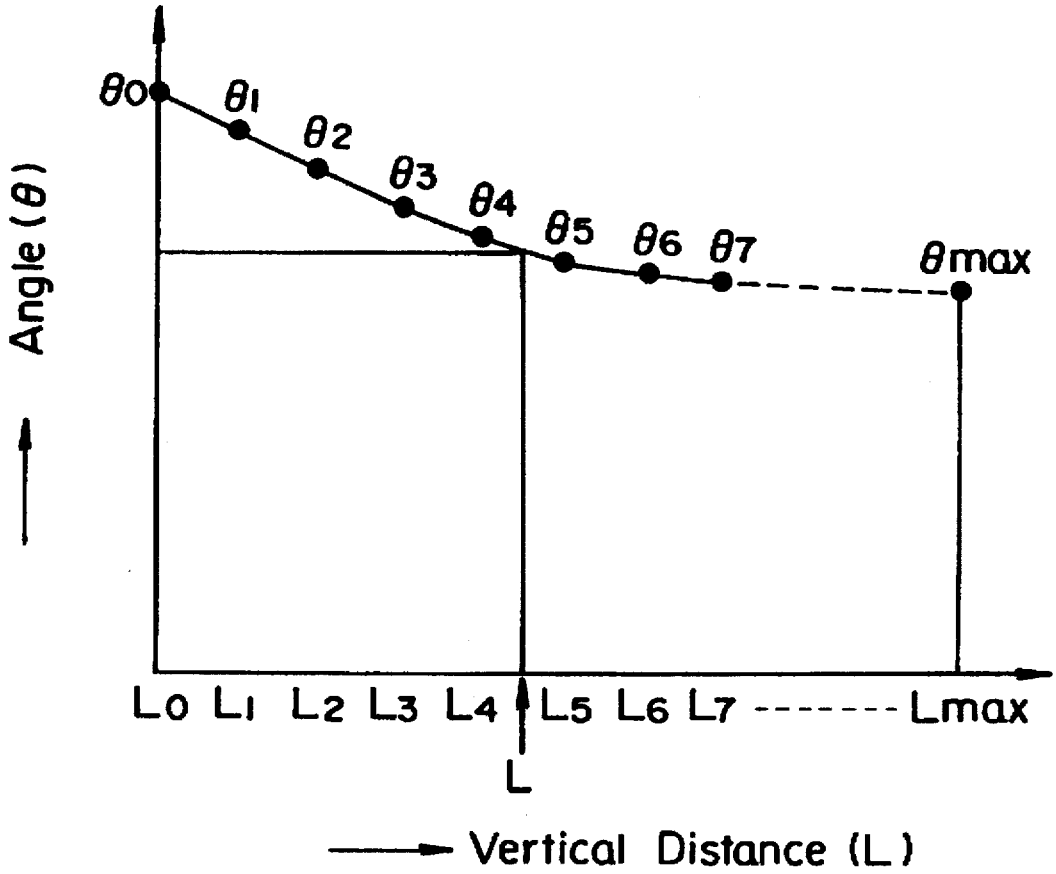
FIG. 1C is a relative illustration of an angle $\theta$ corresponding to the distance L between the reference position and the contact point P of the mantle varied due to its abrasion.

Accordingly, in the case of this preferred embodiment, the angles $\theta_0$, $\theta_1$, $\theta_2$, $\theta_3$ . . . , $\theta_{max}$ based on empirical rule corresponding to the vertical distances $L_0$, $L_1$, $L_2$, $L_3$ . . . , $L_{max}$ ranging from the reference position S to the contact point Pa of the concave 2 which varies as shown in FIG. 1C are inputted in advance into the angle inputting and outputting device. In addition, the vertical distances $L_0$, $L_1$, $L_2$, $L_3$ . . . , $L_{max}$ and the distance Lb ranging from the reference position S to the contact point P of the mantle 3 are detected together by the distance sensing device and at the same time each of the distances detected by the distance sensing device is inputted into the clearance calculating device and the difference $\Delta L$ is calculated by the clearance calculating device.

In concurrent with this operation, the angle $\theta$ corresponding to the vertical distance L ranging from the reference position S detected by the distance sensing device to the contact point P of the concave 2 varying due to wear is selected from the angles $\theta_0$, $\theta_1$, $\theta_2$, $\theta_3$ . . . , $\theta_{max}$ by the angle inputting device, the selected angle $\theta$ is inputted into the clearance calculating device and at the same time the outlet clearance G is calculated in reference to a product of the aforesaid difference $\Delta L$ and a cosine of the selected angle $\theta$, i.e. a product of $\Delta L \times \cos\theta$.

As being apparently understood from the foregoing description, the matter of the present preferred embodiment differing from that of the first preferred embodiment consists in the fact that the mantle 3 is merely moved up and down and the outlet clearance G is calculated in reference to the angles $\theta_0$, $\theta_1$, $\theta_2$, $\theta_3$ . . . , $\theta_{max}$ based on an empirical rule in the same manner as that of the first preferred embodiment, so that the third preferred embodiment can provide the substantially same effect as that found in the aforesaid preferred embodiments.

In the third preferred embodiment, there has been described the case in which the angle $\theta$ corresponding to the vertical distance L ranging from the reference position S to the contact point Pb of the concave 2 varying due to abrasion is inputted in advance into the angle inputting and outputting device. However, it may also be applicable to the third preferred embodiment that the functional equation of $\theta=F(L)$ is inputted in advance into the angle inputting and outputting device as disclosed in the second preferred embodiment, for example.

What is claimed is:

1. A method for determining an outlet clearance of a cone crusher comprising the steps of:

sensing a first distance between a contact point and a reference position under a condition in which a concave and a mantle are contacted to each other;

sensing a second distance between said contact point and said reference position under a condition in which the concave and the mantle are spaced apart from each other;

calculating a difference between said first distance and said second distance; and selecting an empirically determined angle between a horizontal line passing through said contact point and a slant surface of the concave or the mantle as a function of a vertical distance between the contact point and the reference position; and determining the outlet clearance based upon the selected angle.

2. A method for sensing an outlet clearance of a cone crusher according to claim 1, wherein said concave is movable.

3. A method for sensing an outlet clearance of a cone crusher according to claim 1, wherein said mantle is movable.

4. A method for sensing an outlet clearance of a cone crusher according to claim 1, wherein setting said angle corresponding to said vertical distance is carried out by linear interpolation using data of angles at a plurality of predetermined vertical distances.

5. A method for sensing an outlet clearance of a cone crusher according to claim 1, wherein setting said angle corresponding to said vertical distance is carried out on basis of a functional equation of a predetermined vertical distance and said angle.

6. A method for sensing an outlet clearance of a cone crusher according to claim 1, wherein said step of determining the outlet clearance based upon the selected angle comprises calculating a product of a cosine value of the selected angle.

* * * * *